United States Patent [19]

Prieskorn

[11] 4,157,529

[45] Jun. 5, 1979

[54] LEAD FOR RESISTOR ELEMENT

[75] Inventor: Kenneth M. Prieskorn, Manchester, N.H.

[73] Assignee: AMF Incorporated, White Plains, N.Y.

[21] Appl. No.: 833,674

[22] Filed: Sep. 15, 1977

[51] Int. Cl.[2] ..... H01C 1/034

[52] U.S. Cl. ..... 338/275; 338/226; 338/287; 338/329; 338/322

[58] Field of Search ..... 338/226, 243, 252, 254, 338/255, 273–276, 283, 287, 322–326, 329, 330, 334; 29/610, 613, 619, 621; 361/306–307

[56] References Cited

U.S. PATENT DOCUMENTS

| | | | |
|---|---|---|---|
| 2,640,903 | 6/1953 | Kohring | 338/273 X |
| 3,238,490 | 3/1966 | Thomson | 338/273 |
| 3,411,124 | 11/1968 | Total et al. | 338/273 X |

FOREIGN PATENT DOCUMENTS

| | | | |
|---|---|---|---|
| 1086993 | 8/1954 | France | 338/275 |

*Primary Examiner*—C. L. Albritton

*Attorney, Agent, or Firm*—George W. Price; John H. Gallagher

[57] ABSTRACT

A resistor device of simple construction particularly adapted for use as a precision, low ohmic value resistor. The terminal leads are axially aligned and extend outwardly from a molded housing. The inner end of each lead is shaped into a flat surface to facilitate the welding thereto of a resistor element and to minimize twisting of the embedded end of the lead. A radially extending disc shaped portion on each lead is adjacent the flat portion and is embedded in the molded housing to prevent axial movement of the embedded end of the lead. The embedded flat and disc shaped portions serve to minimize forces from acting on the weld joints to break the welds. The resistance element is free standing wire shaped into a serpentine configuration and embedded in the molded housing.

1 Claim, 1 Drawing Figure

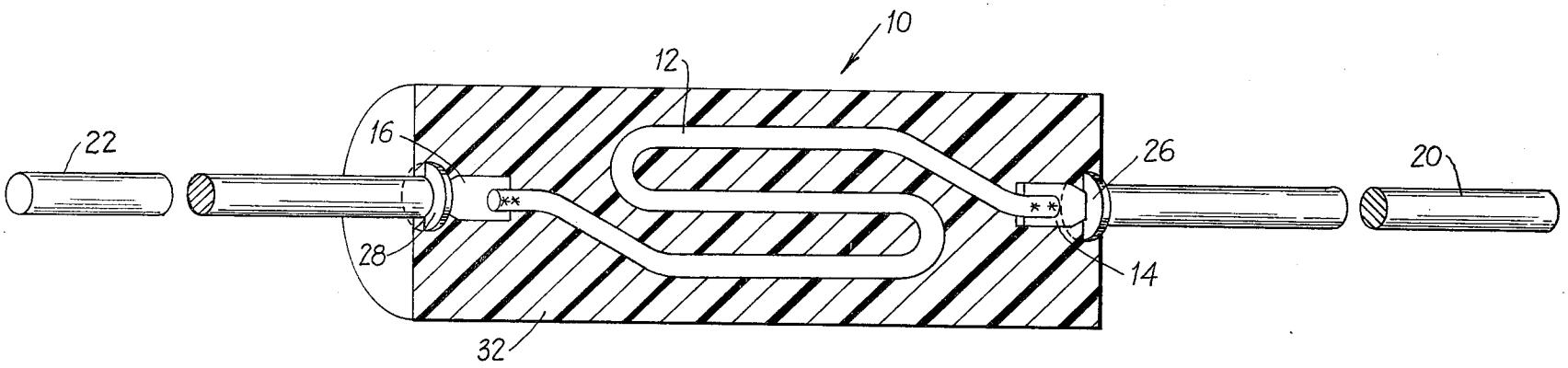
20
26
14
10
12
32
16
28
22

LEAD FOR RESISTOR ELEMENT

BACKGROUND OF THE INVENTION

The present invention relates to molded electrical components and is particularly useful in resistor elements of low ohmic values that have a housing molded thereabout. Low value resistance elements are useful in the use of meters, such as voltmeters, wherein the meter is connected in shunt across the resistance element. It is desirable that the element have a very precise value of resistance and that it dissipate little energy from the circuit in which is it connected. From a manufacturing standpoint it is desirable that the resistance element have as few parts as possible, be simple to assemble (preferably automatically), and result in a high yield of commercially acceptable devices.

In the manufacture of resistor elements themselves, and in their handling during shipping and during the process of their assembly and incorporation into an electronic system or end product, they sometimes are subjected to considerable physical abuse.

It has been found in the past that resistor devices in which a resistance element was welded to electrical leads extending from a molded housing experienced an undesirably high failure rate because the weld joints broke.

The present invention minimizes the above problem by providing a simple structure in which the ends of connector leads are so shaped that when embedded within the molded housing they substantially eliminate twisting and axial forces on the embedded ends of the leads, thereby minimizing destructive forces on the weld joints.

BRIEF DESCRIPTION OF THE DRAWINGS

The invention will be described in connection with the accompanying drawing which is a perspective view, partly in cross section, of a resistor element constructed in accordance with my invention.

DESCRIPTION OF PREFERRED EMBODIMENT

Referring in detail to the drawings, the resistor device 10 is comprised of a resistance element 12 that is made of a selected resistance material having a low ohmic value and is so constructed and arranged to provide a desired resistance value. Resistance element 12 may be any commercially available material and may be in any cross sectional shape. As examples, the resistance wires may range in diameter from 0.0035 inch to 0.0285 inch. Representative values of resistance may be between 0.01 and 10 ohms. Suitable wires are sold under the trademarks Cupron and Evanohm by Wilber B. Driver Company, Newark, N.J. Resistance element 12 is secured, as by welding, at each end to a respective flat portion 14 and 16 at the adjacent ends of connector leads 20 and 22. Resistance element 12 and connector leads 20 and 22 are illustrated as having circular cross sections. It is desired that resistance element 12 be rigid enough to be self supporting in its desired position relative to leads 20 and 22 in the absence of any supporting means.

Each lead has a disc shaped portion 26, 28 formed integrally thereon adjacent the respective flat portions 14 and 16. The integral flat portions 14, 16 and disc shaped portions 26 and 28 are formed on leads 20 and 22 as by swaging.

A housing 32 of an electrical insulating plastic material is molded around resistance element 12 and around the adjacent ends of leads 20 and 22. Any suitable molding material may be used. I have used a commercially available material identified as DC 307 Silicone Molding Compound, a product of Dow Corning Company, Midland, Mich.

As illustrated, the flat portions 14, 16 and disc shaped portions 26 and 28 of the leads are within the molded housing 32. Desirably, the flat portions 14 and 16 are wider than the diameters of connector leads 20 and 22 to serve as anchors in the molded housing 32 to prevent twisting and rotation of the leads relative to resistance element 12. The flat surfaces 14 and 16 also facilitate the welding of the resistance element 12 to leads 20 and 22. The embedded disc shaped portions 26 and 28 also serve as anchors to minimize axial movements of leads 20 and 22 relative to resistance element 12. The anchors minimize forces acting on the welded joints between the ends of resistance element 12 and leads 20 and 22 and thus minimizes broken welds, a source of component failure.

The fact that the welded resistance element 12 is self supporting between leads 20 and 22 considerably simplifies the manufacture of the devices and adapts them for automatic assembly, thus minimizing cost. It is not necessary to wind the resistance element on a supporting core or bobbin, nor is it necessary to employ the stainless steel cup shaped end caps that are conventional in the art. The elimination of the end cups, or equivalent devices, eliminates additional welded or soldered joints and thus eliminates the respective thermal EMFs that unavoidably accompany such joints.

The particular serpentine shape illustrated in the accompanying drawing is but one example of the shapes the resistance element may take. Other shapes may be used without departing from the teachings of the present invention. Similarly, the resistance element may have cross sectional shapes other than circular.

The illustrated resistor device may be manufactured by employing known methods. Resistance element 12 may be shaped and formed in any suitable manner, either manually or automatically. Since the manner of forming the element is not the subject of this invention, it will not be further discussed. Resistance element 12 and leads 20, 22 may be clamped in a suitable jig to permit welding of the ends of the resistance element to the flat portions 14 and 16 on the leads. The illustrated unitary structure of leads 20 and 22 simplifies the manufacture of this subassembly. Subassemblies then may be inserted into molds and the housings 32 molded by any suitable molding technique.

In its broader aspects, this invention is not limited to the specific embodiment illustrated and described. Various changes and modifications may be made without departing from the inventive principles herein disclosed.

What is claimed is:

1. A molded electrical resistor comprising first and second axially aligned and spaced apart electrical leads, each lead being circular in cross section throughout most of its length but having an integral substantially flat portion at one end and an integral radially extending disc shaped portion located inwardly from and adjacent the flat portion, a resistance wire having first and second ends, each end of the resistance wire being welded to a flat portion on a respective one of the leads, said resistance wire being self supporting when welded to the leads, each of said flat portions on the end of a lead having a continuous surface that is wider than the diameter of its respective lead that has a circular cross section, thereby to provide a flat surface to facilitate welding the resistance wire thereto, a plastic housing molded about and engaging the self supporting resistance wire and the ends of the leads that include the flat and radially extending portions, whereby the leads are bound in the molded housing by the flat and radial portions thereby to minimize twisting and axial forces on the welds that secure the resistance wire to said leads.

* * * * *